US012104622B2

(12) United States Patent
Theodossiou

(10) Patent No.: US 12,104,622 B2
(45) **Date of Patent: *Oct. 1, 2024**

(54) MOTORIZED PRESSURE EXCHANGER WITH A LOW-PRESSURE CENTERBORE

(71) Applicant: Energy Recovery, Inc., San Leandro, CA (US)

(72) Inventor: Alexander Patrick Theodossiou, Alameda, CA (US)

(73) Assignee: Energy Recovery, Inc., San Leandro, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/237,721

(22) Filed: Aug. 24, 2023

(65) Prior Publication Data

US 2024/0018977 A1 Jan. 18, 2024

Related U.S. Application Data

(63) Continuation of application No. 17/900,663, filed on Aug. 31, 2022, now Pat. No. 11,761,460, which is a continuation of application No. 17/190,379, filed on Mar. 2, 2021, now Pat. No. 11,555,509.

(51) Int. Cl.

| | |
|---|---|
| ***F04F 13/00*** | (2009.01) |
| ***E21B 43/26*** | (2006.01) |
| ***E21B 43/267*** | (2006.01) |

(52) U.S. Cl.

CPC ..... *F04F 13/00* (2013.01); *E21B 43/267* (2013.01)

(58) Field of Classification Search

CPC ..... F04F 13/00; E21B 43/267

USPC ..... 418/75–77, 79

See application file for complete search history.

(56) References Cited

U.S. PATENT DOCUMENTS 3,190,542 A * 6/1965 Vickery ..... F02B 33/42 60/39.45
3,431,747 A 3/1969 Hashemi et al.
3,910,587 A * 10/1975 Loeffler ..... F16J 15/3456 277/408

(Continued)

FOREIGN PATENT DOCUMENTS

CN 101440828 A 5/2009
CN 101865191 A 10/2010

(Continued)

OTHER PUBLICATIONS

Danfoss: "Energy Recovery Device iSave 21 Plus and iSave 40," Nov. 22, 2021, pp. 1-30, Retrieved from URL: https://assets.danfoss.com/documents/39896/A1243586503158en-000402.pdf.

(Continued)

*Primary Examiner* — Charles G Freay
(74) *Attorney, Agent, or Firm* — LOWENSTEIN SANDLER LLP

(57) ABSTRACT

A pressure exchanger includes a rotor configured to receive first fluid, receive second fluid, and exchange pressure between the first fluid and the second fluid. The pressure exchanger further includes a first component forming a low-pressure port, wherein the first fluid is routed between the rotor and the low-pressure port via a low-pressure passageway. The pressure exchanger further includes a second component forming a fluid passageway between the low-pressure passageway and a centerbore of the pressure exchanger.

18 Claims, 10 Drawing Sheets

(56) References Cited

U.S. PATENT DOCUMENTS

| | | | | |
|---|---|---|---|---|
| 4,529,360 | A | 7/1985 | Kirchhofer et al. | |
| 7,815,421 | B2 | 10/2010 | Bross et al. | |
| 9,920,774 | B2 | 3/2018 | Ghasripoor et al. | |
| 9,945,210 | B2 * | 4/2018 | Theodossiou | F04F 13/00 |
| 10,119,379 | B2 | 11/2018 | Richter et al. | |
| 10,167,710 | B2 | 1/2019 | Ghasripoor et al. | |
| 10,557,482 | B2 | 2/2020 | Anderson | |
| 11,555,509 | B2 * | 1/2023 | Theodossiou | E21B 43/267 |
| 11,761,460 | B2 * | 9/2023 | Theodossiou | F04F 13/00 417/64 |
| 2006/0032808 | A1 | 2/2006 | Hauge | |
| 2006/0037907 | A1 | 2/2006 | Shumway | |
| 2011/0008182 | A1 * | 1/2011 | Krogsgard | F04F 13/00 417/63 |
| 2014/0048143 | A1 | 2/2014 | Lehner et al. | |
| 2015/0184492 | A1 | 7/2015 | Ghasripoor et al. | |
| 2016/0032691 | A1 | 2/2016 | Richter et al. | |
| 2016/0040511 | A1 | 2/2016 | Theodossiou | |
| 2017/0321521 | A1 | 11/2017 | Lewis et al. | |
| 2019/0257323 | A1 | 8/2019 | Shampine | |
| 2019/0277110 | A1 | 9/2019 | Shampine | |
| 2020/0063545 | A1 | 2/2020 | Shampine | |

FOREIGN PATENT DOCUMENTS

| | | | |
|---|---|---|---|
| CN | 101865192 | A | 10/2010 |
| CN | 201723528 | U | 1/2011 |
| CN | 103814223 | A | 5/2014 |
| CN | 106922164 | A | 7/2017 |
| DE | 102011055568 | A1 | 5/2013 |
| EP | 4036421 | A1 | 8/2022 |
| JP | 2012206019 | A | 10/2012 |
| JP | 2013204461 | A | 10/2013 |
| WO | 2005018782 | A1 | 3/2005 |

OTHER PUBLICATIONS

International Search Report and Written Opinion for International Application No. PCT/US2022/016483, mailed May 13, 2022, 10 Pages.

Office Action for Danish Application No. PA202270069, mailed Apr. 21, 2023, 6 Pages.

Office Action for Chinese Patent Application No. CN202280006212.3, mailed Sep. 29, 2023, 13 Pages.

Supplementary European Search Report for European Application No. 22763751.9, mailed Apr. 16, 2024, 08 Pages.

Supplementary Chinese Search Report for Chinese Application No. 202280006212.3, mailed Apr. 19, 2024.

* cited by examiner

MOTORIZED PRESSURE EXCHANGER WITH A LOW-PRESSURE CENTERBORE

RELATED APPLICATIONS

This application is a continuation of U.S. patent application Ser. No. 17/900,663, filed Aug. 31, 2022, which is a continuation of U.S. patent application Ser. No. 17/190,379, filed Mar. 2, 2021, issued as U.S. Pat. No. 11,555,509, the contents of all are hereby incorporated by reference in their entirety.

TECHNICAL FIELD

Some embodiments of the present disclosure relate, in general, to a motorized pressure exchanger with a low-pressure centerbore.

BACKGROUND

Well completion in the oil and gas industry often involves hydraulic fracturing (often referred to as fracking or fracing) to increase the release of oil and gas in rock formations to provide an oil or gas well. Hydraulic fracturing involves pumping a fluid (e.g., frac fluid) containing a combination of water, chemicals, and proppant (e.g., sand, ceramics) into a well at high pressures. The high pressures of the fluid increases crack size and crack propagation through the rock formation to release oil and gas, while the proppant prevents the cracks from closing once the fluid is depressurized. Hydraulic fracturing operations use high-pressure pumps to increase the pressure of the frac fluid. Unfortunately, the proppant in the frac fluid may interfere with the operation of the rotating equipment. In certain circumstances, the solids may slow or prevent the rotating components from rotating.

BRIEF DESCRIPTION OF THE DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Figure 1:
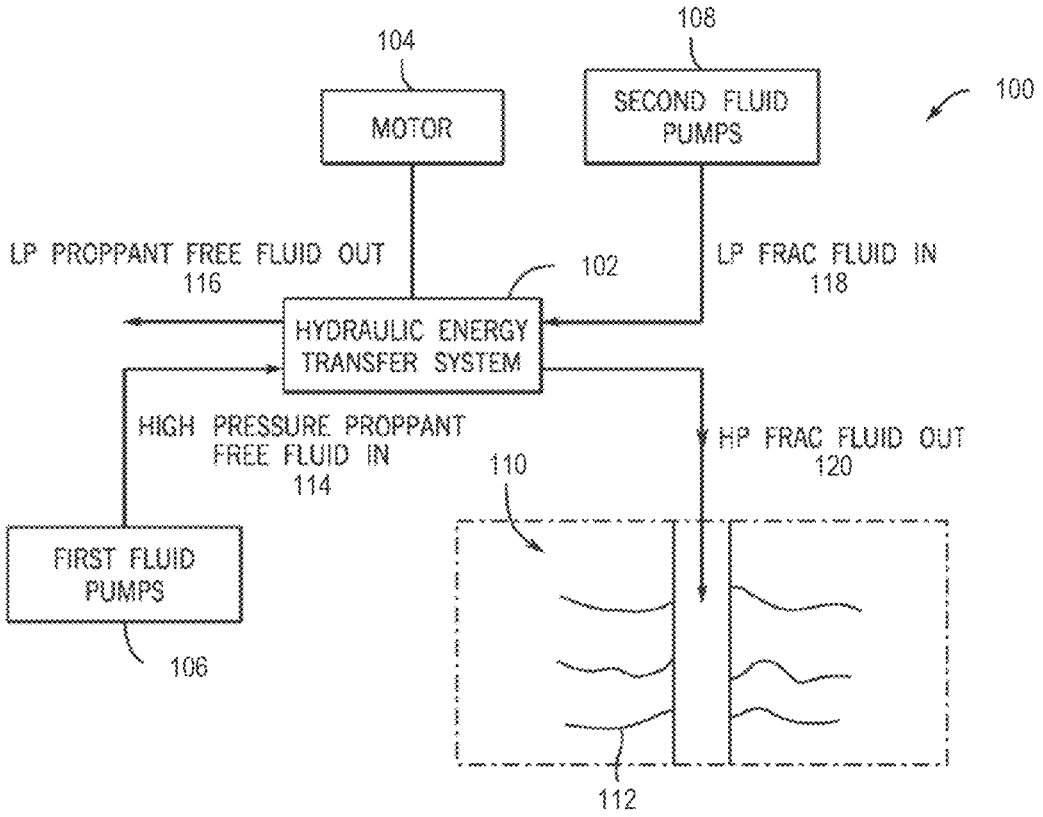
FIG. 1 illustrates a schematic diagram of a fluid handling system, according to certain embodiments.

Embodiments describe herein are related to a motorized hydraulic energy transfer system.

Many industrial processes operate at an elevated pressure and have high-pressure waste streams. One way of providing a high pressure to operations requiring elevated pressure is to transfer pressure from a high-pressure fluid (e.g., high-pressure waste fluid) to a usable fluid for the high-pressure operations (e.g., frac fluid). A particular efficient type of pressure exchange is a rotary pressure exchanger. A rotary pressure exchanger uses a cylindrical rotor with longitudinal channels aligned parallel to the rotational axis. The rotor spins inside a sleeve enclosed by two end covers. Pressure energy is transferred directly from the high-pressure stream to the low-pressure stream in the channels of the rotor. Some fluid that remains in the channels serves as a barrier that inhibits mixing between the streams. The channels of the rotor charge and discharge as the pressure transfer process repeats itself.

High-pressure fluid entering a pressure exchanger causes components (e.g., seals) of the pressure exchanger to be under high pressure. Conventional pressure exchangers are limited in amount of pressure that can be transferred between fluids. In some conventional pressure exchangers, the seals limit the amount of pressure that can be transferred (e.g., high-pressure fluid cannot have a pressure higher than the seals can support). In some conventional pressure exchangers, one or more additional components (e.g., pressure compensators, canned motors, etc.) are used to help compensate for the seals. The manufacturing of the additional parts and coupling of the additional components to the pressure exchangers is an additional cost, an additional component that can fail, and are not readily available.

The devices and systems disclosed herein provide a hydraulic energy transfer system (e.g., rotary isobaric pressure exchanger (IPX)) that is capable of operating with high-pressure incoming fluid (e.g., upwards of 15 kilo pounds per square inch (ksi), or up to a pressure of an incoming fluid) while maintaining a centerbore under low pressure (e.g., under 150 pounds per square inch (psi) or as low as an outgoing fluid). The hydraulic energy transfer system may include a low-pressure port designed to receive a first fluid under a first pressure. The hydraulic energy transfer system may further include a rotor fluidly coupled to (e.g., in a flow path of the low-pressure port). The rotor may form a set of rotating longitudinal channels designed to receive and exchange pressure between the first fluid and a second fluid. The hydraulic energy transfer system may further include a shaft routed through a centerbore formed by the hydraulic energy transfer system. The shaft may be attached to the rotor. The hydraulic energy transfer system may form a low-pressure passageway from the low-pressure port to an opening of one of the channels in the set of channels of the rotor. The hydraulic energy transfer system may further form a fluid passageway from the low-pressure passageway to the centerbore. The fluid passageway may result in the centerbore and shaft being under a low pressure (e.g., lower than the pressure of the first incoming fluid at a high pressure).

In some embodiments, the hydraulic energy transfer system (e.g., rotary IPX) may include an assembly (e.g., cartridge assembly) having a first seal plate that forms a first hydraulic chamber (e.g., hydraulic chamber structure) to receive a first fluid under a first pressure. The assembly may further include a first end cover connected to the first seal plate, the first end cover forming a first set of apertures configured to direct flow of the first fluid from the first hydraulic chamber into a first side of a rotor via the first set of apertures. The assembly may further include a rotor connected to the first end cover, the rotor may form a set of rotating longitudinal channels to receive the first fluid on a side of the rotor from the first end cover, receive a second fluid on a second side of the rotor, and exchange pressure between the first fluid and the second fluid. The assembly may further include a shaft routed through a centerbore formed by the assembly. The shaft may be attached to the rotor. The assembly may form a fluid passageway from the first hydraulic chamber to the centerbore. A first pressure of the first hydraulic chamber may be communicated to the centerbore formed by the first seal plate, the first end cover, and the rotor via the fluid passageway. This first pressure may be a low pressure (e.g., 150 psi) resulting in the centerbore being held at the low pressure while the rotor is in operation.

The devices and systems disclosed herein have advantages over conventional solutions. The hydraulic energy transfer system may have a low-pressure centerbore (e.g., under 150 psi, or substantially equivalent to a low-pressure fluid entering the system) within a rotary IPX operating with an incoming high-pressure fluid (e.g., 15 ksi or substantially equivalent to an incoming high-pressure fluid). The low-pressure centerbore allows for the use of an easily sourced, compact, and reliable shaft seal without requiring custom manufacturing or designing conventional pressure compensators and/or canned motor systems combinations. The low-pressure centerbore may allow for a wider variety of shaft seals and/or motor systems capable of coupling to the rotary IPX, such as seal and motor system designed for various operations and functionality. The low-pressure centerbore may also allow for instrumentation through the low-pressure centerbore that may not be possible in a high-pressure centerbore. This may include taking real time measurements within the rotary IPX. For example, diagnostic measurements may be performed while the rotary IPX is in operation.

FIG. 1 illustrates a schematic diagram of a fluid handling system 100 including a hydraulic energy transfer system 102 (e.g., rotary IPX) and a motor system 104, according to certain embodiments. The fluid handling system 100 (e.g., a frac system or hydraulic fracturing system) includes a hydraulic energy transfer system 102, a motor system 104 coupled to the hydraulic energy transfer system 102, first fluid pumps 106, and second fluid pumps 108. The hydraulic energy transfer system 102 transfers work and/or pressure between a first fluid (e.g., a pressure exchange fluid, such as a proppant-free fluid) and a second fluid (e.g., frac fluid, such as a proppant-laden fluid). The first fluid may include low-pressure (LP) proppant free fluid out 116 that is directed from the hydraulic energy transfer system 102 and high-pressure (HP) proppant free fluid in 114 that is directed from first fluid pumps 106 to the hydraulic energy transfer system 102. The second fluid may include low-pressure (LP) frac fluid in 118 that is directed toward the hydraulic energy transfer system 102 and high-pressure (HP) frac fluid out 120 that is directed from the hydraulic energy transfer system 102 to a frac site (e.g., rock formation 110). These fluids may be multi-phase fluids such as gas/liquid flows, gas/solid particulate flow, liquid/solid particulate flows, gas/liquid/solid particulate flows, or any other multi-phase flow. For example, the multi-phase fluids may also be non-Newtonian fluids (e.g., shear thinning fluid), highly viscous fluids, non-Newtonian fluids containing proppant, or highly viscous fluids containing proppant. Further, the first fluid may be at a pressure between approximately 5,000 kPa to 25,000 kPA, 20,000 kPa to 50,000 kPa, 40,000 kPa to 75,000 kPa, 75,000 kPa to 100,000 kPa, and/or greater than a second pressure of the second fluid. The hydraulic energy transfer system 102 may or may not completely equalize pressure between the first and second fluids. Accordingly, the hydraulic energy transfer system 102 may operate isobarically, or substantially isobarically.

The hydraulic energy transfer system 102 may also be described as a hydraulic protection system, a hydraulic buffer system, or a hydraulic isolation system, because the hydraulic energy transfer system 102 may block or limit contact between a frac fluid and various hydraulic fracturing equipment (e.g., high-pressure pumps, second fluid pumps 108), while still exchanging work and/or pressure between the first and second fluids. By blocking or limiting contact between various pieces of hydraulic fracturing equipment and the second fluid (e.g., proppant containing fluid). Moreover, the hydraulic energy transfer system 102 may enable the hydraulic fracturing system, for example, high-pressure pumps that are not designed for abrasive fluids (e.g., frac fluids and/or corrosive fluids). In some embodiments, the hydraulic energy transfer system may be a rotating isobaric pressure exchanger (e.g., rotary IPX). Rotating isobaric pressure exchangers may be generally defined as devices that transfer fluid pressure between a high-pressure inlet stream and a low-pressure inlet stream at efficiencies in excess of approximately 50%, 60%, 70%, 80%, or 90% without utilizing centrifugal technology. Centrifugal technology may include a device spinning a fluid at a high speed to separate fluids of different densities. The fluids are forced outward from a radial direction about a central rotating axis. The notation of "first" fluid and "second" fluid is merely exemplary and not used to identify or limit each fluid to any specified limitation herein.

In some embodiments, the hydraulic energy transfer system 102 may include or be a part of a refrigeration system (e.g. trans-critical carbon dioxide refrigeration system) that uses a fluid in a supercritical state. For example, the first and/or second fluid may include a refrigerant (e.g. carbon dioxide).

To facilitate rotation, the hydraulic energy transfer system 102 may couple to a motor system 104 (e.g., an out-board motor system) or may include a motor system 104 within a casing of the hydraulic energy transfer system (e.g., an in-board motor system). For example, the motor system may include an electric motor, a hydraulic motor, a pneumatic motor, another rotary drive, or any combination thereof. In operation, the motor system 104 enables the hydraulic energy transfer system 102 to rotate with highly viscous and/or fluids that have solid particles, powders, debris, etc. For example, the motor system 104 may facilitate startup with highly viscous or particulate-laden fluids, which enables a rapid start of the hydraulic energy transfer system 102. The motor system 104 may also provide additional force that enables the hydraulic energy transfer system 102 to grind through particulate to maintain a proper operating speed (e.g., rpm) with a highly viscous/particulate-laden fluid. Additionally, the motor system 104 may also substantially extend the operating range of the hydraulic energy transfer system 102. For example, the motor system 104 may enable the hydraulic energy transfer system 102 to operate with good performance at lower or higher flow rates than a "free-wheeling" hydraulic energy transfer system without a motor system, because the motor system 104 may facilitate control of the speed (e.g., rotating speed) of the hydraulic energy transfer system 102 and control of the degree of mixing between the first and second fluids. For example, during well completion operations the fluid handling system 100 pumps a pressurized particulate-laden fluid that increases the release of oil and gas in rock formations 110 by propagating and increasing the size of cracks 112. In order to block the cracks 112 from closing once the fluid handling system 100 depressurizes, the fluid handling system 100 uses fluids that have solid particles, powders, debris, etc. that enter and keep the cracks 112 open.

In order to pump this particulate-laden fluid into the well, the fluid handling system 100 may include one or more first fluid pumps 106 and one or more second fluid pumps 108 coupled to the hydraulic energy transfer system 102. For example, the hydraulic energy transfer system 102 may be a rotary IPX. In operation, the hydraulic energy transfer system 102 transfers pressures without any substantial mixing between a first fluid (e.g., proppant free fluid) pumped by the first fluid pumps 106 and a second fluid (e.g., proppant containing fluid or frac fluid) pumped by the second fluid pumps 108. In this manner, the hydraulic energy transfer system 102 blocks or limits wear on the first fluid pumps 106 (e.g., high-pressure pumps), while enabling the fluid handling system 100 to pump a high-pressure frac fluid into the well (e.g., rock formation 110) to release oil and gas. In order to operate in corrosive and abrasive environments, the hydraulic energy transfer system 102 may be made from materials resistant to corrosive and abrasive substances in either the first and second fluids. For example, the hydraulic energy transfer system 102 may be made out of ceramics (e.g., alumina, cermets such as carbide, oxide, nitride, or boride hard phases, etc.) within a metal matrix (e.g., Co, Cr or Ni or any combination thereof) such as tungsten carbide in a matrix of CoCr, Ni, NiCr or Co.

The hydraulic energy transfer system 102 may include a low-pressure port designed to receive a first fluid under a first pressure. The hydraulic energy transfer system 102 may further include a rotor (e.g., rotor 304 of FIG. 3) fluidly coupled to (e.g., in a flow path of the low-pressure port). The hydraulic energy transfer system 102 may further include a shaft (e.g., shaft 302 of FIG. 3) routed through a centerbore formed by the hydraulic energy transfer system 102. The shaft may be attached to the rotor. The hydraulic energy transfer system 102 may form a low-pressure passageway from the low-pressure port to the rotor. The hydraulic energy transfer system 102 may further form a fluid passageway from the low-pressure passageway to the centerbore. The fluid passageway may result in the centerbore and shaft being under a low pressure (e.g., lower than the pressure of the first incoming fluid at a high pressure).

Figure 2:
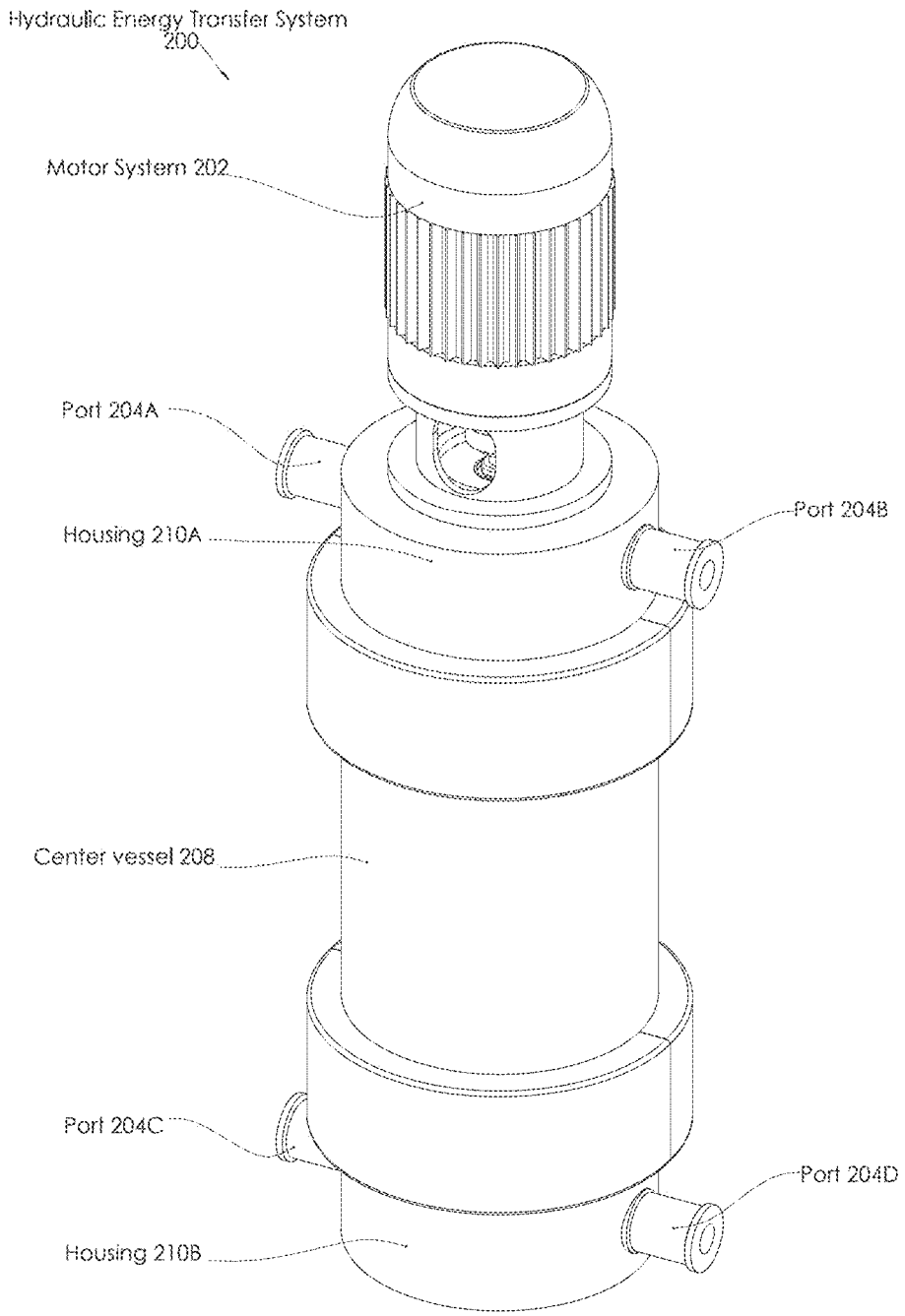
FIG. 2 illustrates a perspective view of a hydraulic energy transfer system, according to certain embodiments.

FIG. 2 illustrates a perspective view of a hydraulic energy transfer system 200 (e.g., rotary IPX), according to certain embodiments. Some elements of FIG. 2 may have the same number as other figures, and these elements may be substantially similar to those elements having the same number in other figures. The hydraulic energy transfer system 200 may include a rotor enclosed by a center vessel 208. The center vessel 208 may be coupled to (e.g., connected, adhered to, or in contact with) housing 210A and housing 210B by seals 206A-B. The hydraulic energy transfer system 200 may further include ports 204A-D and a motor system 202.

As shown in FIG. 2, the hydraulic energy transfer system 200 may include ports 204A-D. In some embodiments, a first pair of ports 204A-B is disposed on a first side of the hydraulic energy transfer system 200, and a second pair of ports 204C-D is disposed on a second side of the hydraulic energy transfer system. In some embodiments, the first fluid (e.g., proppant free fluid) and/or second fluid (e.g., proppant containing fluid or frac fluid) is received and outputted on the same side of the hydraulic energy transfer system 200. For example, port 204B may receive a first fluid and port 204A may output the first fluid. Port 204C may input a second fluid and port 204D may output the second fluid. In some embodiments, a high-pressure first fluid enters a port (e.g., ports 204A-B) on a first side of the hydraulic energy transfer system 200 and transfers pressure to a second fluid that enter a port (e.g., ports 204C-D) on a second side of the hydraulic energy transfer system 200. The high-pressure second fluid may be outputted by a port (e.g., ports 204C-D) on a second side of the hydraulic energy transfer system 200. It should be noted the role of each port 204A-D may be interchangeable based on the desired flow path of the first and second fluid.

In some embodiments, ports 204A-B may be integrated into housing 210A and ports 204C-D are integrated into housing 210B. Pressures from the first and second fluid enclosed by the hydraulic energy transfer system 200 may be applied to the housing. For example, the housing may experience a compression force resulting from the pressurized first fluid and pressurized second fluid entering and exiting ports 204A-D.

As shown in FIG. 2 the housing 210A-B is coupled to the center vessel 208 through seals. The seals 206A-B may include a fluid seal (e.g., piston seals, rod seals, wiper seals, wear rings, clamps, gaskets, and the like) that prevent the first and second fluid from flowing through a contact surface disposed between the housing 210A-B and the center vessel 208. In some embodiments, the center vessel 208 is selectively coupled to the housing 210A-B such that the center vessel 208 can easily be removed, replaced, repaired, and/or reinstalled.

As shown in FIG. 2 the motor system 202 is coupled to the housing 210A. As discussed further in other embodiments, the motor system 202 facilitates operation of a rotor enclosed by center vessel 208 by providing torque for grinding through particulate, maintaining the operating speed of the rotor, controlling the mixing of fluids within the hydraulic energy transfer system 200 (e.g., changing the rotating speed of a rotor enclosed within the center vessel 208), or starting the rotor with highly viscous or particulate-laden fluids.

In some embodiments, one of ports 204A-D may be a low-pressure port designed to receive a first fluid under a first pressure. The hydraulic energy transfer system 200 may further include a rotor (e.g., disposed within center vessel 208) fluidly coupled to (e.g., in a flow path of the low-pressure port). The hydraulic energy transfer system 200 may further include a shaft (e.g., shaft 302 of FIG. 3) routed through a centerbore formed by the hydraulic energy transfer system 200. The shaft may be attached to the rotor. The hydraulic energy transfer system 200 may form a low-pressure passageway from the low-pressure port to the rotor. The hydraulic energy transfer system 200 may further form a fluid passageway from the low-pressure passageway to the centerbore. The fluid passageway may result in the centerbore and shaft being under a low pressure (e.g., lower than the pressure of the first incoming fluid at a high pressure).

In the some embodiments, the hydraulic energy transfer system 200 may be a frac system. However, it should be appreciated that the hydraulic energy transfer system 200 may be any suitable system capable of handling an abrasive (e.g., particulate-laden) fluid. For example, the hydraulic energy transfer system 200 may be configured for water injection, for well recovery, and fluid transportation using the hydraulic energy transfer system 200 as a pump. In embodiments in which the fluid handling system is a frac system, the frac system pumps a pressurized particulate-laden fluid that increases the release of oil and gas in rock formations by propagating and increasing the size of cracks.

Figure 3:
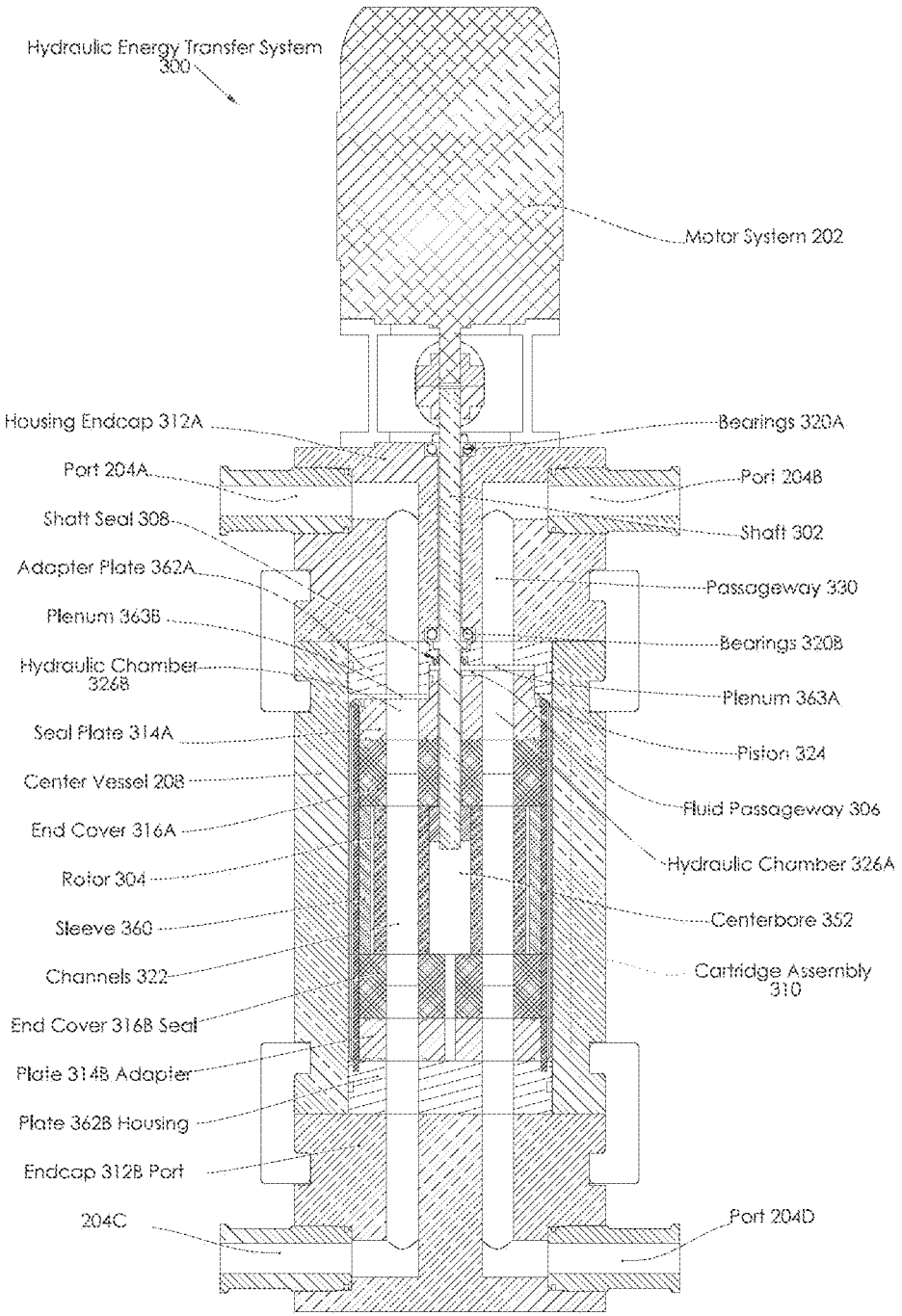
FIG. 3 illustrates a cross-sectional view of a hydraulic energy transfer system, according to certain embodiments.

FIG. 3 illustrates a cross-sectional view of a hydraulic energy transfer system 300 (e.g., hydraulic energy transfer system 200 of FIG. 2, hydraulic energy transfer system 102 of FIG. 1, etc.), according to certain embodiments. Some elements of FIG. 3 may have the same number as other figures, and these elements may be substantially similar to those elements having the same number in other figures. The hydraulic energy transfer system 300 may include a motor system 202 coupled to a housing endcap 312A through shaft 302. The shaft 302 may be disposed in a centerbore formed by the hydraulic energy transfer system 300. The centerbore (depicted in FIG. 3 with shaft 302 enclosed) may include a shaft seal 308 that seals fluid from a motor side of the centerbore and fluid from the rotor side of the centerbore from interacting and/or mixing. The hydraulic energy transfer system includes a housing endcap 312A that integrates ports 204A-B and housing endcap 312B that integrates ports 204C-D. The hydraulic energy transfer system may further include a center vessel 208 disposed between the housing endcaps 312A-B. The center vessel 208 may enclose a cartridge assembly 310. In some embodiments, housing endcaps 312A-B are integrated together to form a single casing that encloses the cartridge assembly 310, Alternatively or additionally, the housing endcaps 312A-B may be integrated with the center vessel 208 (e.g. to completely enclose the cartridge assembly).

As shown in FIG. 3, the hydraulic energy transfer system 300 may include one or more adapter plates 362A-B. The one or more adapter plates 362A-B may be coupled to (e.g., connected, adhered to, or in contact with) the one or more housing endcaps 312A-B. For example, the adapter plates 362A-B and the housing endcaps 312A-B may be coupled together with fasteners, adhesives, or other adhering techniques known in the art (e.g., welding, brazing, riveting, etc.) Alternatively, the adapter plates 362A-B may be integrated with housing endcaps 312A-B. The one or more adapter plates 362A-B may include recesses or bores configured to receive the cartridge assembly 310. For example, the cartridge assembly may include one or more pistons (e.g., piston 324) that permit axial movement of the cartridge assembly 310 relative to the housing endcaps 312A-B within the center vessel 208.

As shown in FIG. 3, and as will be discussed in greater detail in association with other figures, the hydraulic energy transfer system 300 includes a cartridge assembly 310. The cartridge assembly 310 may include piston 324. In some embodiments, the hydraulic energy transfer system 300 may include more pistons beyond piston 324. Piston 324 may be coupled to one or more seal plates 314A-B. For example, piston 324 may be coupled to, incorporated with, or integrated into seal plate 314A. The seal plate 314A may be coupled to end cover 316A. End cover 316A may be coupled to a sleeve 360. Sleeve 360 may be coupled to end cover 316B. The end cover 316B may be coupled to seal plate 314B. The sleeve 360 may enclose a rotor 304. In some embodiments, the cartridge assembly 310 is adapted to receive a first fluid from ports 204A-B (e.g. a high-pressure first fluid may enter through port 204A and a low-pressure first fluid may exit through port 204B) and a second fluid from ports 204C-D (e.g. a low-pressure second fluid may enter through port 204D and a high-pressure second fluid may exit through 204B). The cartridge assembly is further to transfer pressure from one of a high-pressure first fluid to a low-pressure second fluid or a high-pressure second fluid to a low-pressure first fluid. It should be noted, the flow path of high-pressure fluid and low low-pressure fluid as well as the first fluid and the second fluid can be generalized to any port 204A-D and any hydraulic chamber 326A-B and not limited to a specific flow path identified herein. It should also be noted, that the use of "first" and "second" is exemplary, and the limitations described for the first fluid could apply to the second fluid.

In some embodiments, the hydraulic energy transfer system 300 includes piston 324. The piston may be coupled to adapter plates 362A-B and/or seal plate 314A-B. The piston may be adapted to permit axial movement of the cartridge assembly relative to the adapter plate 312A-B while maintaining a seal between the cartridge assembly 310 and adapter plate 362A-B. For example, the piston 324 may axially move towards or away from the adapter plate 362A-B to increase a compression force on the cartridge assembly 310 and laterally shift the cartridge assembly 310 between housing endcaps 312A-B.

As shown in FIG. 3, the hydraulic energy transfer system 300 forms a passageway 330 (e.g., low-pressure passageway). Passageway 330 may be disposed between port 204B and seal plate 314A. For example passageway 330 may transfer fluid from port 204B to hydraulic chamber 326A. In another example, the passageway 330 may transfer fluid from hydraulic chamber 326A to port 204B. In some embodiments, the passageway 330 transfers fluid of a high pressure (e.g., pressure of the highest pressure fluid entering the system) or fluid of a low pressure (e.g., pressure of the lowest pressure fluid entering the system).

As shown in FIG. 3, the hydraulic energy transfer system 300 forms a fluid passageway 306 disposed between passageway 330 and the centerbore 352). For example, the fluid passageway 306 may allow fluid to pass between passageway 330 and the centerbore 352 (e.g. on the rotor side of shaft seal 308 or on the motor side of shaft seal 308). Fluid passageway 306 may be formed by one or more of housing endcaps 312A-B, piston 324, seal plates 314A-B, end covers 316A-B, and/or rotor 304. Fluid passageway 306 allows fluid to flow between passageway 330 and the centerbore 352 (e.g. on the rotor side of shaft seal 308 or on the motor side of shaft seal 308). Fluid passageway 330 may be disposed between one of ports 204A-D and the rotor 304. In some embodiments, the pressure of a fluid disposed within fluid passageway 306 is communicated to the shaft and flows through apertures in seal plate 314A, end cover 316A, and/or rotor 304. In some embodiments, fluid passageway 306 is formed between a centerbore 352 formed by the system and piston 324, the port 204B, and/or passageway 330. The centerbore 352 may include a channel formed through one or more components of the hydraulic energy transfer system 300. The centerbore 352 may include substantially the same diameter. The center may be designed to receive a shaft 302. There may be a gap between the shaft 302 and the surface of the centerbore 352. For example, the shaft 302 may be designed to rotate and the centerbore 352 may provide sufficient space to eliminate contact between the shaft 302 and the surface of the centerbore 352.

As shown in FIG. 3, the hydraulic energy transfer system 300 includes a motor system 202. As illustrated, the motor system 202 includes a shaft 302 that couples to the rotor 304 through a housing endcap 312A. Specifically, the shaft 302 may be routed through an aperture in the housing endcap 312A, an aperture in the seal plate 314A, an aperture in the end cover 316A, and into an aperture of the rotor 304. Apertures formed by one or more of housing endcap 312A, the seal plate 314A, the end cover 316A, rotor 304, end cover 316B, seal plate 314B and/or housing endcap 312B may form a centerbore 352 of the system. The seal plate 314A and the end cover 316A may form corresponding portions of a centerbore 352 formed by the hydraulic energy transfer system 300. To facilitate rotation of the shaft 302, the motor system 202 may also include one or more bearings 320A-B that support the shaft 302. The bearings 320A may be disposed within or external to the housing endcap 312A-B. In some embodiments, the shaft 302 may extend completely through the rotor 304 and the end cover 316B. This may enable the shaft 302 to be supported by the end cover 316B and/or seal plate 314B on opposite sides of the rotor 304.

In operation, the motor system 202 facilitates operation of the rotor 304 by providing torque for grinding through particulate, maintaining the operating speed of the rotor 304, controlling the mixing of fluids within the hydraulic energy transfer system 300 (e.g., changing the rotating speed of the rotor 304), and/or starting the rotor 304 with highly viscous or particulate-laden fluids. The motor may be coupled to a controller (not illustrated) that uses feedback from sensor to control the motor system. The controller may include a processor and a memory (not illustrated) that stores non-transitory computer instructions executable by a processor. For example, as the controller receives feedback from one or more sensor, the processor executes instructions stored in the memory to control power output from the motor system.

In some embodiments, a controller using sensor feedback may control the extent of mixing between the first and second fluids in the hydraulic energy transfer system 300 which may be used to improve overall operability. For example, varying the proportions of the first and second fluids entering the hydraulic energy transfer system 300 allows an operator to control the amount of fluid mixing occurring within the system. Three possible characteristics of rotary IPX that affect mixing are: (1) the aspect ratio of the rotor channels 322 (2) the short duration of exposure between the first and second fluids, and (3) the creation of a fluid barrier (e.g., an interface) between the first and second fluids within the rotor channels 322. First, the rotor channels 322 are generally long and narrow, which stabilizes the flow within the rotary IPX. In addition the first and second fluids may move through the channels 322 in a plug flow regime with minimal axial mixing. Second, in certain embodiments, the speed of the rotor 304 reduces contact between the first and second fluids. For example, the speed of the rotor 304 may reduce contact times between the first and second fluids to less than approximately 0.15 seconds, 0.10 seconds, or 0.05 seconds. Third, a small portion of the rotor channel 322 is used for the exchange of pressure between the first and second fluids. A volume of fluid may remain in the channel 322 as a barrier between the first and second fluids. All these mechanisms may limit mixing within the cartridge assembly 310 Moreover, in some embodiments, the cartridge assembly 310 may be designed to operate with one or more internal pistons that isolate the first and second fluids while enabling pressure transfer.

Figure 4:
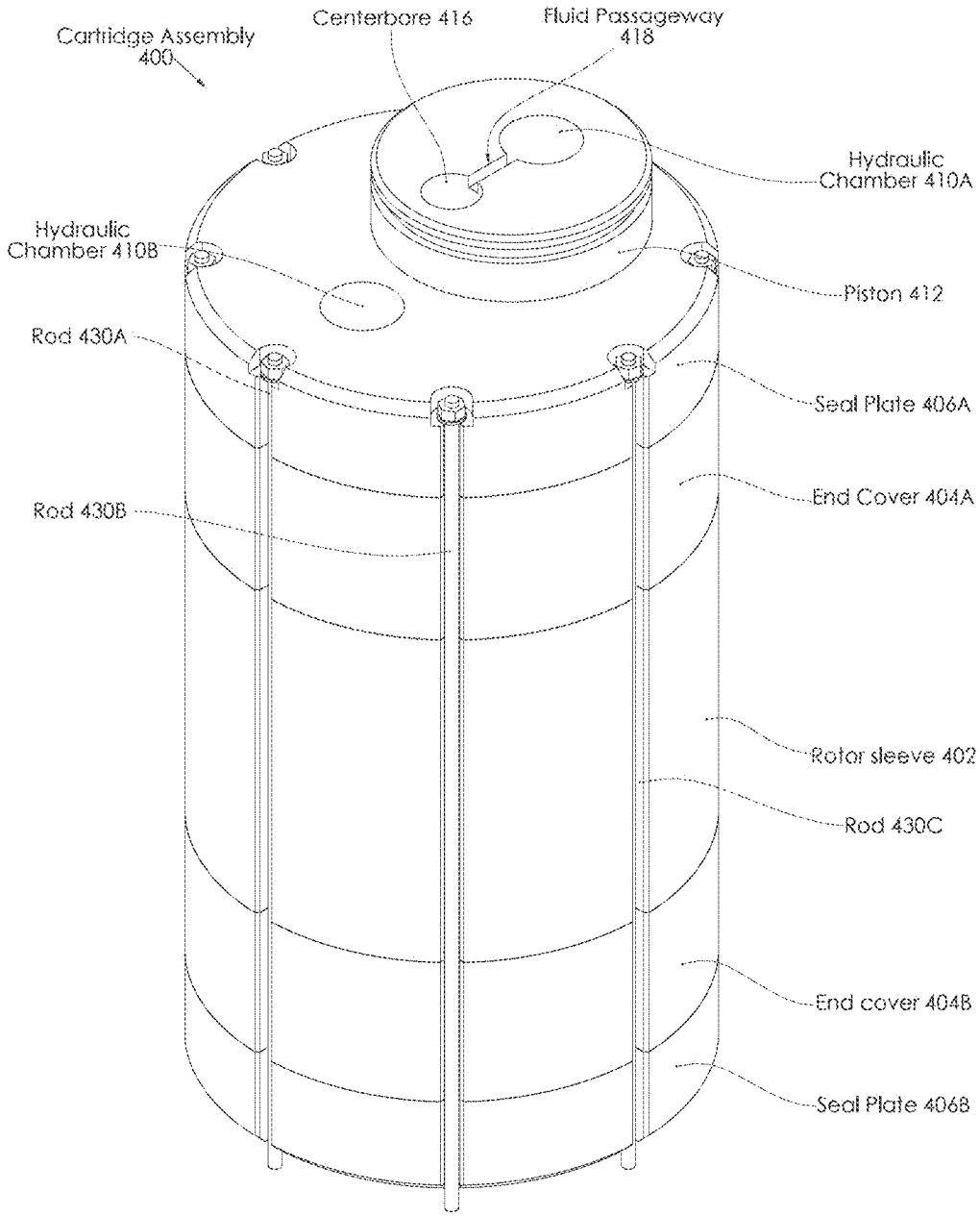
FIG. 4 illustrates a perspective view of a cartridge assembly of a hydraulic energy transfer system, according to certain embodiments.

FIG. 4 illustrates a perspective view of a cartridge assembly 400 of a hydraulic energy transfer system (e.g., hydraulic energy transfer system 200-300 of FIGS. 2-3 or a rotary IPX), according to certain embodiments. Some elements of FIG. 4 may have the same number as other figures, and these elements may be substantially similar to those elements having the same number in other figures. The cartridge assembly 400 transfers pressure and/or work between first and second fluids (e.g., proppant free fluid and proppant laden fluid) with minimal mixing of the fluids. In some embodiments the cartridge assembly 400 is a selectively removable element of a hydraulic energy transfer system (e.g., hydraulic energy transfer system 200-300 of FIGS. 2-3).

As shown in FIG. 4, the cartridge assembly may have a cylindrical body including a rotor sleeve 402, a pair of end covers 404A-B, and a pair of seal plates 406A-B. The cartridge assembly 400 may include a rotor sleeve 402. The rotor sleeve 402 includes a generally cylindrical structure. In some embodiments, the rotor sleeve 402 may include divots or inlets disposed along the circumference of the cylindrical structure to receive securing devices (e.g., compression rods 430A-C). The rotor sleeve 402 may enclose a rotor device (e.g., rotor 502 of FIG. 5). The rotor sleeve 402 may contact at a first side a first end cover 404A and contact at a second side a second end cover 404B. The end cover may include a cylindrical structure. In some embodiments, the diameters of the end covers 404A-B are substantially equal to the diameter of the rotor sleeve 402. The rotor sleeve 402 may include one or more substantially flat surfaces to contact the end covers 404A-B. For example, the rotor sleeve may be coupled to and held together by a friction fit at the contact surface between the rotor sleeve 402 and the end covers 404A-B. The contact surfaces between the rotor sleeve 402 and the end covers 404A-B may include a coating or abrasive texture that promotes friction between the rotor sleeve 402 and the end covers 404A-B The contact surface between the rotor sleeve and the end covers may form a seal to prevent the first and second fluid from exiting the cartridge assembly between the rotor sleeve 402 and the end covers 404A-B. In some embodiments, the rotor sleeve 402 and the end covers 404A-B may be coupled together with fasteners, adhesives, or other adhering techniques known in the art (e.g., welding, brazing, riveting, etc.) In some embodiments a contact surface between the seal plates 406A-B and end covers 404A-B as well as a contact surface between the end covers and a housing (e.g. adapter plates 362A-B or housing endcaps 312A-B of FIG. 3).

In some embodiments, the end covers 404A-B are configured to or adapted to direct flow of a first fluid and a second fluid in and out of a rotor enclosed by the rotor sleeve 402. As will be discussed further, the end covers 404A-B may each include a surface that is adapted to couple with the rotor enclosed by rotor sleeve 402. The end covers may have a cylindrical shape (e.g., similar to the rotor sleeve). The end covers 404A-B are coupled to seal plates 406A-B. The coupling of the end covers 404A-B and the seal plates 406A-B may include similar coupling techniques disclosed regarding the coupling between the rotor sleeve 402 and the end covers 404A. Additionally, the seal plates 406A-B may form a seal between the end covers 404A-B and the seal plates 406A-B. The seal plates 406A-B may also include a cylindrical structure.

As shown in FIG. 4, the cartridge assembly 400 may include one or more seals 408 (e.g., face seals, cartridge seals, radial shaft seals, O-rings, etc.) that are disposed on one or more of the ends of the cartridge assembly. The one or more seals 408 may couple or connect the cartridge assembly 400 to a casing (e.g., housing) of a hydraulic energy transfer system (e.g., hydraulic energy transfer system 200-300 of FIGS. 2-3). In some embodiments, one or more seals 408 may couple the cartridge assembly 400 to the housing of the hydraulic energy transfer system using a friction fit. For example, the pressure of the first and second fluid may apply a force (e.g., a compression force) on the housing of the hydraulic energy transfer system and/or the cartridge assembly to create a friction interface between the hydraulic energy transfer system and the cartridge assembly that generates a seal and holds the cartridge assembly 400 in place. For example, the pressurized first fluid and the pressurized second fluid may result in compression forces directed toward the longitudinal center of the cartridge assembly 400.

In some embodiments, cartridge assembly 400 is designed to generate a net force in a longitudinal direction of the assembly. For example, the cartridge assembly 400 may include a first side, depicted in FIG. 4 proximate seal plate 406A, and a second side depicted proximate seal plate 406B. The compression forces may be adapted to provide a net force directed towards the first side or the second side of the cartridge assembly. This may result in the seal plate 406A, end cover 404A, rotor sleeve 402, end cover 404B, and/or seal plate 406B being under a force from a neighboring element such that each element compresses and forms a seal with each adjacent element. For example, the seal plate 406 may form a seal against the end cover due to this net force. In some embodiments, the net force created across the cartridge assembly 400 results in a friction fit between the elements (e.g., seal plate 406A, end cover 404A, rotor sleeve 402, end cover 404B, and seal plate 406B.) For example, each of these elements may be held in place from the friction generated from a net force applied through the cartridge assembly 400. In some embodiments, these elements may be held together using alignment pins.

In some embodiments, the seal plates 406A-B, the end covers 404A-B, and the sleeve is held together by compression forces based on the pressurized fluid flowing through the cartridge assembly 400. In some embodiment, the cartridge assembly 400 may include one or more compression rods 430A-C. The compression rods 430A-C may include fasteners that are affixed at one or more ends of the compression rods 430A-C and are coupled to the seal plates 403A-C, the end covers 404A-B, and/or the rotor sleeve 402. The compression rods 430A-C may be adapted to compress the cartridge assembly 400 together. For example, a central compression force is applied to the seal plates 406A-B against the end covers 404A-B, and a compression force is applied to the end covers 404A-B against the rotor sleeve 402. In some embodiments, the cartridge assembly is held together with a combination of fluid compression forces and external compression forces (e.g., using compression rods 430A-C). The rotor sleeve 402 enables an enclosed rotor to rotate about a central axis while the cartridge assembly 400 is compressed together.

In some embodiments, the cartridge assembly 400 is enclosed by a fluid disposed in a cavity created between the casing of the hydraulic energy transfer system and the cartridge assembly 400. This fluid may include a fluid bearing comprising a thin layer of rapidly moving pressurized liquid and/or gas between a surface of the cartridge assembly 400 and the casing of the hydraulic energy transfer system.

As shown in FIG. 4, one or more of the seal plates 406A-B may be piston 412 which is disposed on a distal end of a radial surface of a cylindrical protruding structure of the seal plate 406A. As discussed in other embodiments, the seal plates 406A-B include a surface for applying pressure. Pistons 412 is configured to axially slide through a coupling point (e.g. a recess or bore of an adapter plate (e.g. adapter plate 362A of FIG. 3)) to permit relative movement between the cartridge assembly 400 and a casing (e.g., housing endcaps 312A-B of FIG. 3) of a hydraulic energy transfer system (e.g., 200-300 hydraulic energy transfer system of FIGS. 2-3).

In some embodiments, a seal plate 406A may form a high-pressure hydraulic chamber (e.g., 410B) and a low-pressure hydraulic chamber (e.g., 410A). The high-pressure hydraulic chamber (e.g., 410B) may enclose one of the first fluid or the second fluid at a high pressure (e.g., around 15000 ksi) while the low-pressure hydraulic chamber (e.g., 410A) may include one of the first fluid or the second fluid at a low-pressure (e.g., 150 psi). In some embodiments, the high-pressure hydraulic chamber and the low-pressure hydraulic chamber enclose the same fluid, however in other embodiments, the high-pressure hydraulic chamber may include one of the first fluid or the second fluid and the low-pressure hydraulic chamber may include the one of the first fluid or the second fluid that is not included in the high-pressure hydraulic chamber.

As discussed further in other embodiments, the seals plates 406A-B may be designed such that the pressurized fluids in the hydraulic chamber 410A-B generate a substantially similar force to opposing internal cartridge forces (e.g to reduce the net force on the endcovers). 404A-B. Reducing the net on the endcover may reduce the deflections of the bearing surfaces of a rotor disposed within the rotor sleeve 402. It should be noted, as a result of a low-pressure centerbore 416 (e.g., provided by the fluid passageway 418), forces can be generated that can alter the seals and contact points between the seal plates 406A-B, end covers 404A-B, and rotor sleeve 402. The seal plates are designed to counter these forces to minimize net force on the end covers 404A-B. The efficiency of the pressure transfer between the first and second fluids may be improved by minimizing the deflections caused net forces (e.g. pressure imbalance) on the end covers 404A-B.

The cartridge assembly 400 may further include a centerbore 416 and a shaft seal 420. In some embodiments, the shaft seal 420 is disposed within the housing (e.g., housing endcap 312A or adapter plate 362A of FIG. 3). In some embodiments, the cartridge assembly 400 may form a fluid passageway 418 (e.g., fluid passageway structure) in hydraulic communication with the shaft and a hydraulic chamber 410A. In other embodiments, the fluid passageway 418 may be formed by one or more of housing endcaps 312A-B, piston 324, seal plates 314A-B, end covers 316A-B, and/or rotor 304. Fluid passageway 418 allows fluid to flow between hydraulic chamber 410A and centerbore 416. In some embodiments, the pressure of a fluid disposed within fluid passageway 418 is communicated to the centerbore 416 and flows through apertures in one of the seal plate 406A, end cover end cover 404A, rotor 430C, end cover 404B, and seal plate 406B. In some embodiments, fluid passageway 418 is formed between a centerbore 416 formed by the cartridge assembly 400 and piston 412 and/or the hydraulic chamber 410A. The fluid passageway 418 communicates pressure from the seal plate (e.g., pressure of the fluid located in one of the hydraulic chambers 410A-B) to the centerbore 416 disposed along a central axis of the cartridge assembly 400. The fluid passageway 418 may be formed by one of machining or drilling a recess through piston 412, seal plate 406A, end cover 404A, the rotor disposed within the rotor sleeve 402, end cover 404B, seal plate 406B or any combination thereof. In some embodiments the diameter of fluid passageway 418 may be within 1-3 cm.

In some embodiments fluid passageway 418 is substantially uniform in diameter. In some embodiments, the diameter of the fluid passageway is smaller then one of a fluid passageway between hydraulic chamber 410A and the rotor disposed within the rotor sleeve 402. In some embodiments, the hydraulic chamber 410A encloses either the first or second fluid and communicates the pressure of the fluid enclosed in the hydraulic chamber to the centerbore 416. For example, the hydraulic chamber 410A may enclose fluid of a low pressure (150 psi). This fluid communicates this low pressure to the centerbore 416. The cartridge assembly may form a centerbore 416 that encloses a shaft. The centerbore 416 may be routed through seal plate 406A, end cover 404A, and the rotor enclosed within the rotor sleeve 402. The centerbore 416 may be adapted to receive one or more components (e.g., motor shaft, crank, rotary attachment, etc.) of a motor system (e.g., motor system 104 of FIG. 1). The centerbore 416 may further include a shaft seal 420 that seals and separates a portion of the centerbore 416 that is enclosed by the cartridge assembly 400 and a portion of the centerbore 416 that is disposed external to the cartridge assembly 400 (e.g., housing cap 312A of FIG. 3). For example, the shaft seal may hydraulically seal a first region of the centerbore 416 proximate the rotor enclosed by the rotor sleeve 402 from a second region of the centerbore 416 external to the cartridge assembly 400.

In operation, the hydraulic chambers 410A-B enable the first and second fluids (e.g., proppant free fluid) to enter and exit the cartridge assembly. One of hydraulic chambers 410A-B may receive a high-pressure first fluid and after exchanging pressure, the other hydraulic chamber 410A-B may be used to route a low-pressure fluid out of the cartridge assembly 400. The cartridge assembly may also include hydraulic chambers (not shown) on a lower side (proximate seal 308) opposite hydraulic chambers 410A-B. The hydraulic chambers on the lower side may be configured to receive one of the first or second fluids.

Figure 5:
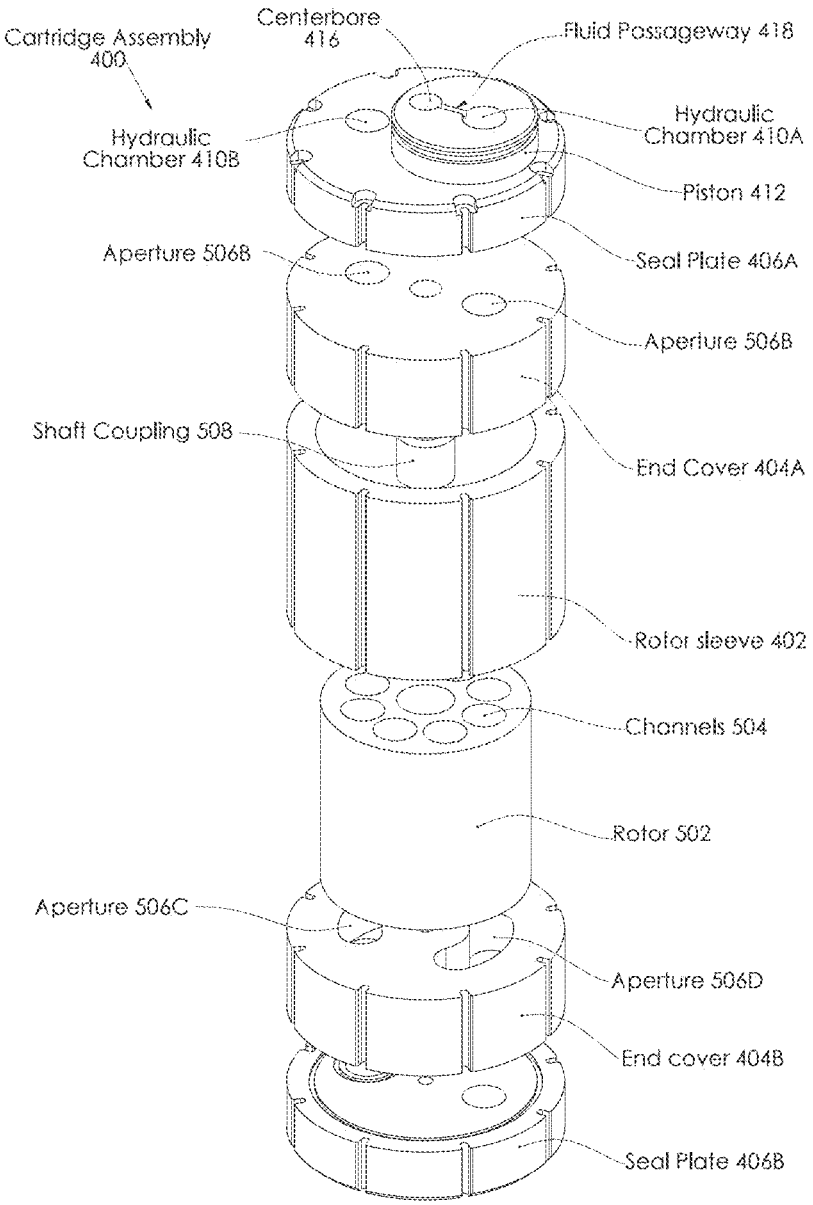
FIG. 5 illustrates an exploded view of a cartridge assembly of a hydraulic energy transfer system, according to certain embodiments.

FIG. 5 illustrates an exploded view of a cartridge assembly 400 of a hydraulic energy transfer system (e.g., hydraulic energy transfer system 120 of FIG. 1, hydraulic energy transfer system 200-300 of FIGS. 2-3, rotary IPX, etc.), according to certain embodiments. Some elements of FIG. 5 may have the same number as other figures, and these elements may be substantially similar to those elements having the same number in other figures. The cartridge assembly 400 may include a rotor sleeve 402 enclosing a rotor 502, end covers 404A-B, and seal plates 406A-B.

The rotor 502 may include a cylindrical structure that is adapted to rotate within the rotor sleeve 402. The rotor 502 may further include one or more channels 504 extending substantially longitudinally through the rotor 502 with openings at each end. The channels 504 may be arranged symmetrically about a central axis. The openings of the channels 504 may be arranged for hydraulic communication between both end covers 404A-B. For example, the rotor 502 is designed to rotate and during rotation the channels 504 are exposed to a fluid at high-pressure and fluid at low-pressure that are directed to the channels by apertures 506A-D formed by end covers 404 A-B. Apertures 506A-D may be in the form of arcs or segments of a circle (e.g., C-shaped).

Figure 6:
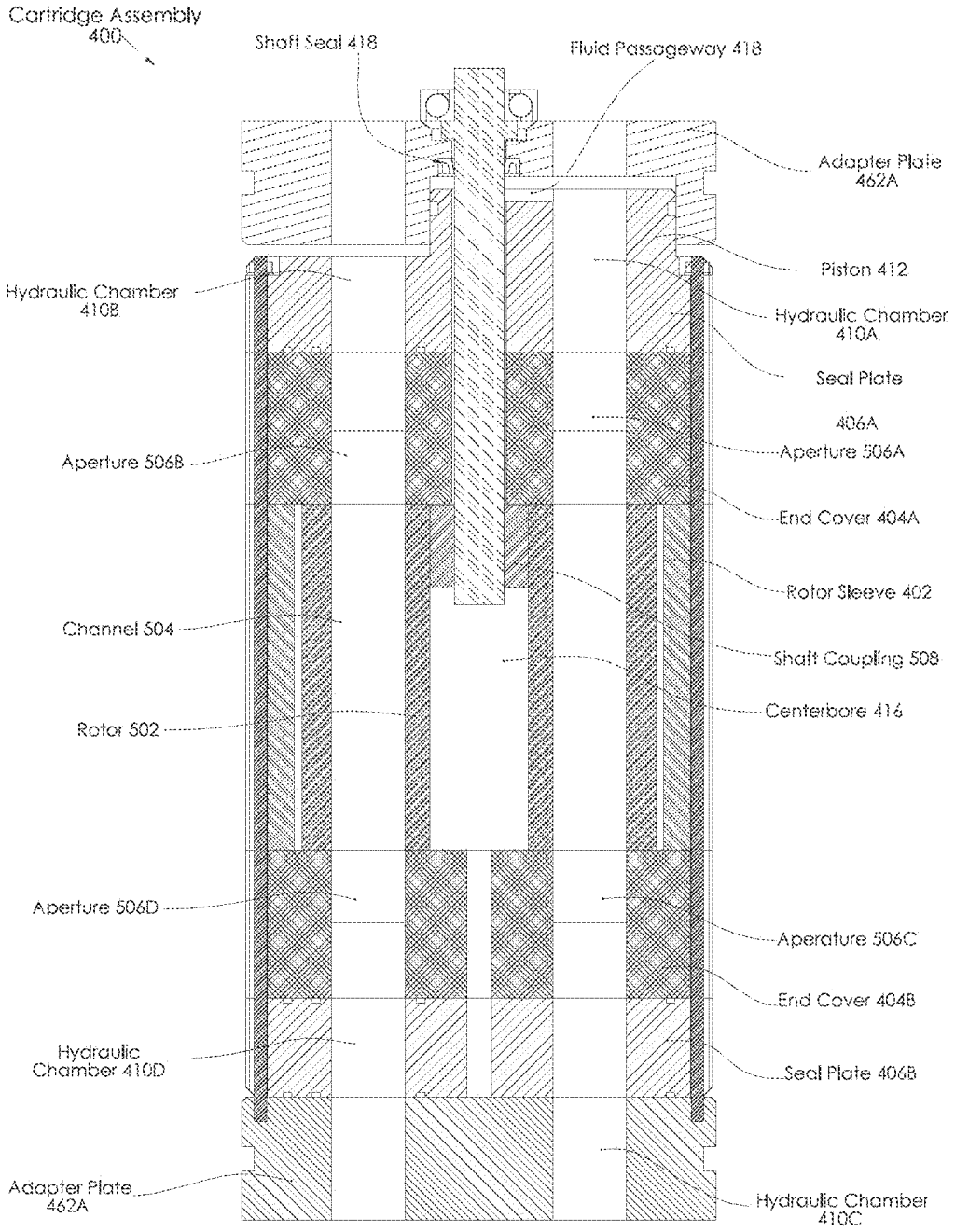
FIG. 6 illustrates a cross-sectional view of a cartridge assembly of a hydraulic energy transfer system, according to certain embodiments.

As shown in FIG. 5, the end covers 404A-B may include a flat surface to contact the rotor sleeve 402 and another flat surface to contact the seal plates 406A. As described in other embodiments, the end covers 404A, the seal plates 406A-B, and the rotor sleeve 402, may all be coupled with friction fit interfaces. For example, compression forces external to the cartridge assembly 400 may hold the end covers 404A, the seal plates 406A-B, the rotor sleeve 402, and the rotor 502 in place and maintain a hydraulic seal at each contact point. In some embodiments, the rotor 502 rotates on bearing surface created by the rotor sleeve 402 and a surface of the end covers 404A-B FIG. 6 illustrates a cross-sectional view of a cartridge assembly 400 of a hydraulic energy transfer system (e.g., hydraulic energy transfer system 120 of FIG. 1, hydraulic energy transfer system 200-300 of FIGS. 2-3, a rotary IPX, etc.), according to certain embodiments. Some elements of FIG. 6 may have the same number as other figures, and these elements may be substantially similar to those elements having the same number in other figures. As shown in FIG. 6, the cartridge assembly 400 may include a seal plate 406A coupled to an end cover 404A. The end cover 404A may be coupled to a rotor sleeve 402 and a rotor 502. The rotor sleeve 402 and the rotor 502 may be coupled to a second end cover 404B. The second end cover may be coupled to a second seal plate 406B.

As shown in FIG. 6, the cartridge assembly 400 may include a centerbore 416 that is adapted to receive a motor system (e.g., motor shaft, crank, rotary elements, etc.). The cartridge assembly 400 may form a centerbore 416 routed through the seal plate 406A, the end cover 404A, and the rotor 502. In some embodiments, the system may further form a centerbore 416 routed through end cover 404B and seal plate 406B. In a further embodiment the 416 may be disposed along a central axis of the cartridge assembly 400. The cartridge assembly may form a centerbore 416 that is routed through both ends of the cartridge assembly 400 (e.g., above the piston 412 and through the hydraulic chamber 410C-D). The centerbore 416 may receive a shaft that may be coupled to the rotor with a shaft coupling 508.

In some embodiments, the centerbore 416 may form a passage (e.g., hole, slot, clearance, centerbore, etc.) through a seal plate 406A, an end cover 404A, and the rotor 502. This passage may communicate a pressure (e.g., low pressure, 150 psi) to a centerbore 416 of the rotor 502. In some embodiments, the cartridge assembly 400 includes a passage external to the cartridge assembly 400 that is in hydraulic communication between the centerbore 416 and a low-pressure fluid flow of a first or second fluid disposed external to the cartridge assembly.

In some embodiments, to compensate for the lower pressure distribution on the inside of the cartridge assembly 400 due to a low-pressure centerbore 416, a larger low-pressure distribution is on the outside of the cartridge to balance forces (i.e. minimize deflections). In one embodiment, the force balance is adjusted by altering the diameter of piston 412. Piston 412 may include plenums 363A-B adapted to counter a force resulting from a low-pressure centerbore 416 by applying a compression force generated by a pressurized fluid disposed within hydraulic chamber 410A. For example, there is a low pressure plenum 363A above the piston 412, and a high pressure plenum 323B. By changing the piston 412 diameter the relative plenum 363A-B areas changes which can adjust the net force. For example, the size of low pressure plenum 363A may be increased (by increasing piston 412 diameter) which corresponds to a decrease high pressure plenum size 363B. In some embodiments, a top seal plate (e.g., seal plate 406A) may set a pressure balance by applying a compression force on the cartridge assembly 400. Seal plate 406A may include two hydraulic chambers 410A-B and a piston 412. The piston 412 may include one or more radial seals (e.g., radial O-rings) that seal into one or more receiving bores of a casing (e.g., housing endcaps 312A-B). The seal plate 406A may include one or more face seals to seal the seal plate onto end cover 404A. In some embodiments the seal plate 406A and end cover 404A are used in combination to establish separate sealed flow paths between hydraulic chambers 410A-B (e.g., a high-pressure chamber and a low-pressure chamber) on the cartridge assembly 400 to ports on a casing (e.g., housing) of a hydraulic energy transfer system (e.g., hydraulic energy transfer system 200-300 of FIGS. 2-3).

In some embodiments, piston 412 include a radial seal (e.g., radial O-rings) that maintain pressure-containment of the cartridge assembly 400 by axially moving under pressures. In some embodiments, the piston 412 allows for relative movement between the casing and the cartridge assembly 400. In some embodiments, the piston 412 accommodates variations in cartridge heights. For example, the cartridge height may be variable due to standard machine tolerance and material removal during repair, replacement, resurfacing of the cartridge assembly 400 or parts associated of the cartridge assembly 400.

In some embodiments, a bottom seal plate (e.g., seal plate 406B) is omitted. For example, one or more face seals of the seal plate 406B are integrated into the casing and couples to the end cover 404B. For example, a seal created at a contact surface between the casing and end cover 404B may be created by increasing a compression force generated by plenums 363A-B.

Figure 7A:
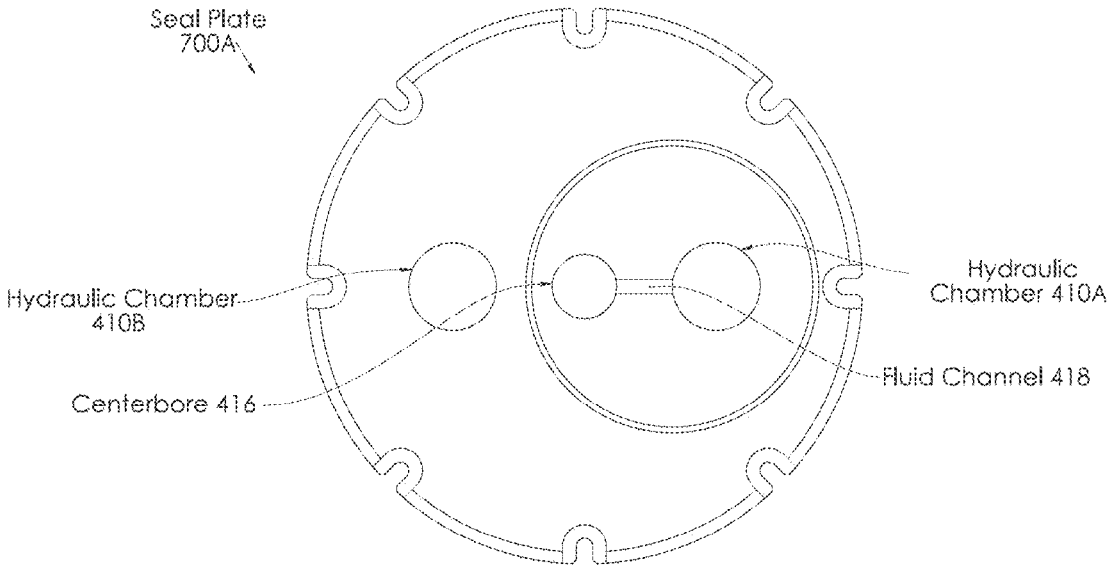
FIGS. 7A-B illustrate seal plates of a cartridge assembly, according to certain embodiments.
Figure 7B:
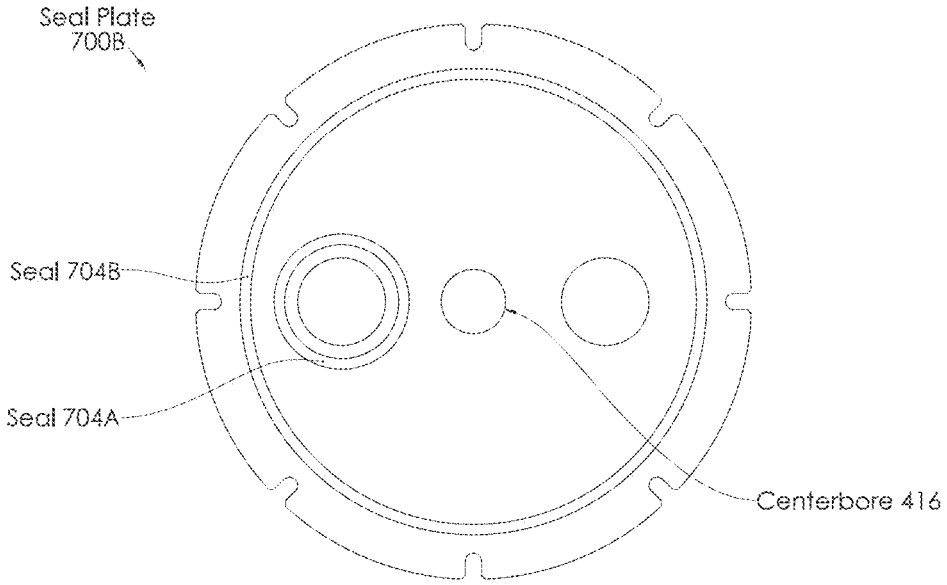

FIGS. 7A-B illustrate seal plates 700A-B of a cartridge assembly (e.g., cartridge assembly 400 of FIG. 4), according to certain embodiments. Some elements in FIGS. 7A-B may have the same number as other figures, and these elements may be substantially similar to those elements having the same number in other figures. Seal plate 700A-B may be an upper seal plate (e.g., seal plate 406A of FIG. 4) of a hydraulic energy transfer system (e.g., hydraulic energy transfer system 300 of FIG. 3). FIG. 7A illustrates a upper surface of a seal plate 700A while FIG. 7B may show a lower surface of a seal plate 700B. The upper surface of the seal plate may be designed to connect to or contact a housing (e.g., housing endcaps 312A from FIG. 3). FIG. 7A shows a top surface of the seal plate 700A. As shown in FIG. 7A, the seal plate 700A may include a first surface (e.g., a top surface) that includes one or more hydraulic chambers 410A-B, piston 412, a fluid passageway 418, a centerbore 416, and a shaft seal 420.

In some embodiments, the seal plate 700A forms a centerbore 416 routed through a center of seal plate 700A that is adapted to receive a shaft. In other embodiments, the seal plate forms a bore disposed off-center that is adapted to receive the shaft. In some embodiments, the centerbore 416 is disposed within a hydraulic chamber 410A or through piston 412. In other embodiments, the centerbore 416 is disposed outside the piston 412 as not to be routed through piston 412.

In some embodiments, a first hydraulic chamber 410A includes one of the first fluid or the second fluid (e.g., proppant free fluid or proppant laden fluid) having a first pressure and a second hydraulic chamber 410B that includes the first fluid or the second fluid having a second pressure that is greater than the first pressure. For example, both hydraulic chambers 410A-B may include the same fluid but with different pressures.

As discussed previously, hydraulic chambers 410A-B can input and/or output the first and/or second fluids. The hydraulic chambers 410A-B are fluidly coupled to a port on a casing (e.g., housing) of a hydraulic energy transfer system (e.g., hydraulic energy transfer systems 200-300 of FIGS. 2-3). For example hydraulic chamber 410A may be an inlet port that transfers fluid into a cartridge assembly and hydraulic chamber 410B may be an outlet port the transfers fluid out of a cartridge assembly.

In some embodiments, the fluid passageway 418 (e.g., fluid passageway structure) is in hydraulic communication with the centerbore 416 and the seal plate 406. For example, the fluid passageway 418 may communicate fluid from one of hydraulic chamber 410A, or piston 412 to the centerbore 416. For example, hydraulic chamber 410A may enclose fluid at a low pressure (e.g., 150 psi) and communicate this pressure to the centerbore 416. The centerbore 416 of the seal plate may communicate this pressure to the centerbore 416 of the rotor, resulting in a centerbore 416 under a pressure that is less than a pressure of a casing of a hydraulic energy transfer system that may enclose the cartridge assembly (e.g., cartridge assembly 400 of FIG. 4).

In some embodiments, seals 704A-B are designed to create a hydraulic seal between the seal plates 700A-B and corresponding end covers (e.g., end covers 404A-B of FIG. 4). As shown in FIG. 7B, a second surface (e.g., a bottom surface) of the seal plate 700B may include one or more seals 704A-B. The seals 704A-B may include a shaft seal or a face seal (e.g., O-rings, gaskets, end face mechanical seals, etc.) to couple the second surface of the seal plate 700B to an end cover (e.g., end cover 404A-B of FIG. 4). For example, the shape of the face seal may enclose a surface that is to contact an end cover. The enclosed surface may create high-pressure and low-pressure areas that result in forces applied to the end cover due to the pressurized fluid enclosed in seal plate 700. In a further example, seal 704B may create a low-pressure area enclosed by seal 704B and seal 704A may create a high-pressure area enclosed by seal 704A. In some embodiments, the relative size and geometry of the regions created by seals 704A-B may be designed to ensure adequate contact pressure between seal plates 406A-B and their respective adjacent endcovers 404A-B to enable proper sealing between the components. In some embodiments, the seal plates 700A-B may form a fluid passageway 418 from the centerbore 416 to one of hydraulic chambers 410A-B.

Figure 8A:
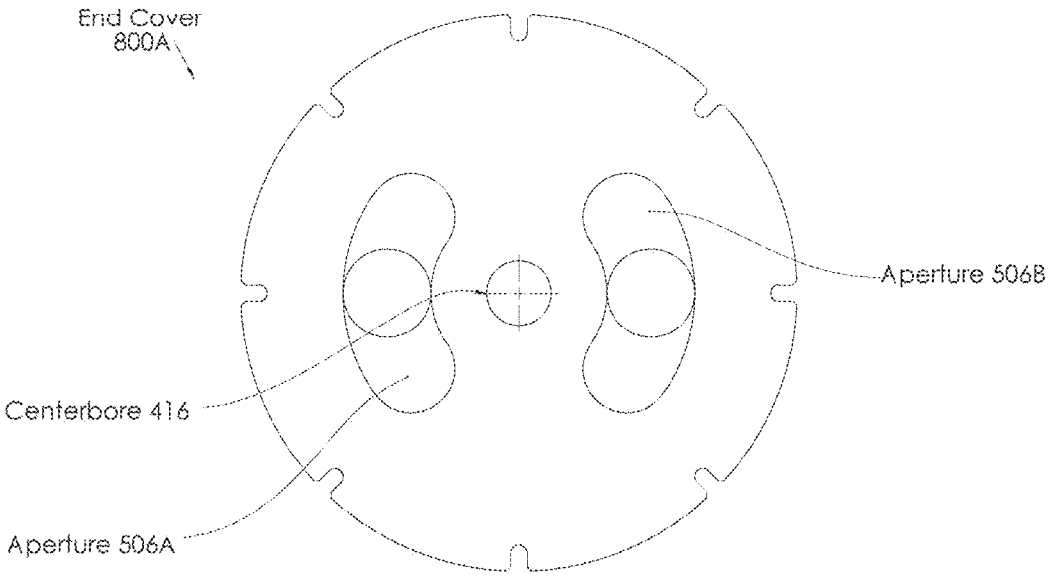
FIGS. 8A-B illustrate end covers of a cartridge assembly, according to certain embodiments.
Figure 8B:
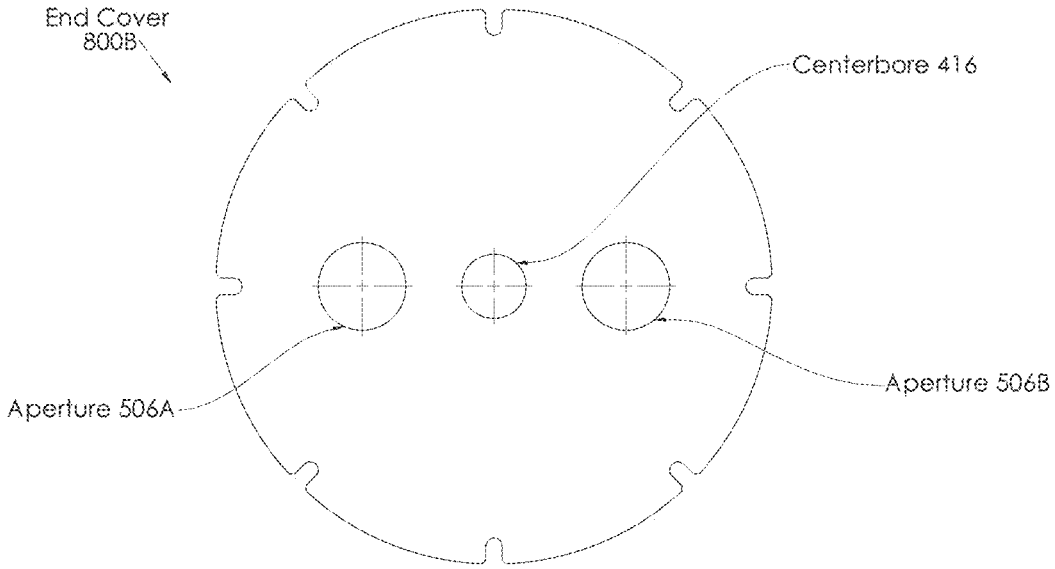

FIGS. 8A-B illustrate end covers 800A-B of a cartridge assembly (e.g., cartridge assembly 400 of FIG. 4), according to certain embodiments. Some elements in FIGS. 8A-B may have the same number as other figures, and these elements may be substantially similar to those elements having the same number in other figures. FIG. 8A show a first surface (e.g., top surface) of the end cover 800A includes one or more apertures 506A-B and a centerbore 416. The top surface may be configured to be coupled to, connected with, or integrated with one of seal plates 700A-B. FIG. 8B show a second surface (e.g., a bottom surface) of the end cover 800B. The bottom surface may be configured to be coupled to, connect with, or integrate with a rotor.

The one or more apertures 506A-B may be formed by the end cover and be adapted to direct fluid flow from a seal plate (e.g., seal plate 406A-B of FIG. 4) to and from channels (e.g., channels 504 of FIG. 5) of a rotor (e.g., rotor 502 of FIG. 5). In some embodiments, the apertures 506A-B are larger than the openings of the channels (e.g., channels 504 of FIG. 5). For example, apertures 506A-B may be designed in the form of arcs or segments of a circle (e.g., C-shaped).

Figure 9A:
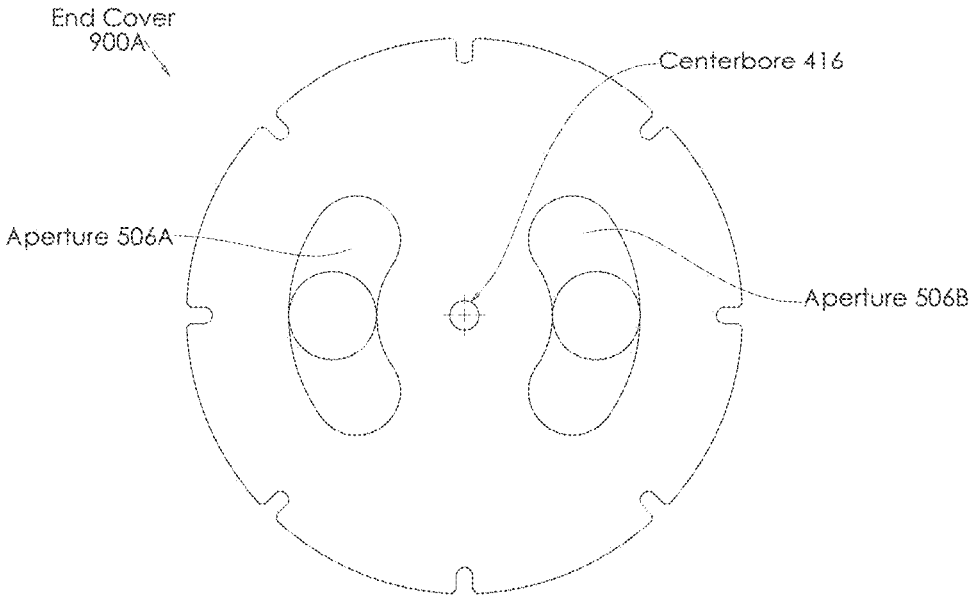
FIGS. 9A-B illustrate end covers of a cartridge assembly, according to certain embodiments.
Figure 9B:
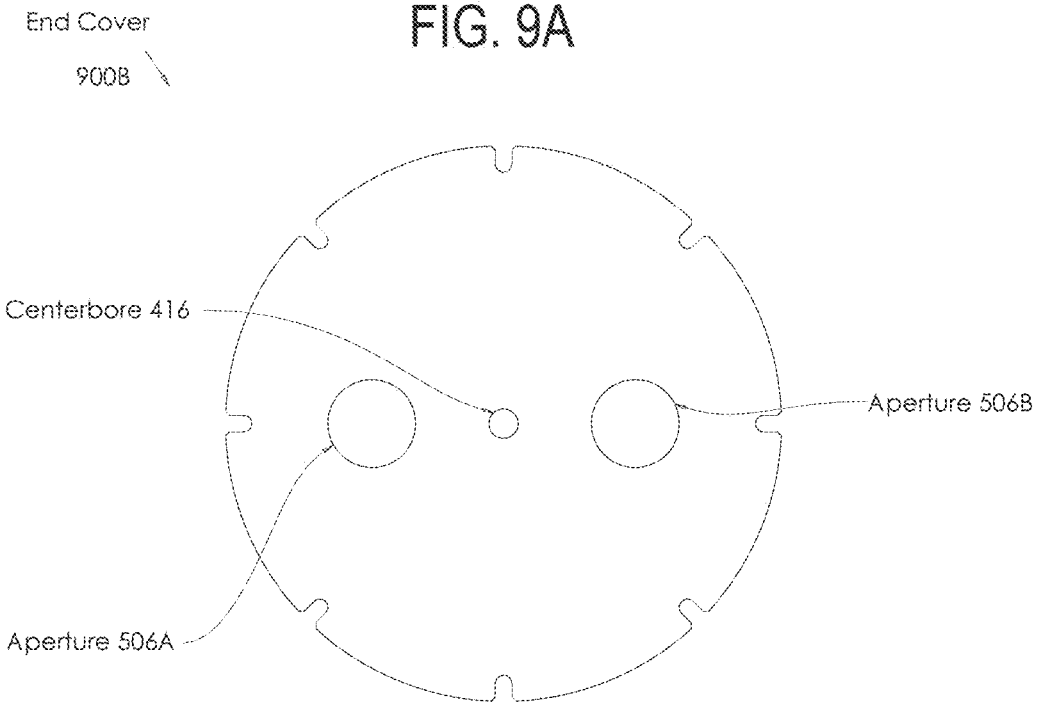

FIGS. 9A-B illustrate end covers 900A-B of a cartridge assembly (e.g., cartridge assembly 400 of FIG. 4), according to certain embodiments. Some elements in FIGS. 9A-B may have the same number as other figures, and these elements may be substantially similar to those elements having the same number in other figures. As shown in FIG. 9A, the end cover 900A may form one or more apertures 506A-B and a centerbore 416. As shown in FIG. 9B, the end cover 900B may include a centerbore 416 and apertures 506A-B. Embodiments and corresponding elements illustrated in FIGS. 9A-B may include or be similar to features of end cover 800A-B as disclosed in association with FIGS. 8A-B. In some embodiments, the end covers 900A-B forms one or more fluid passageways. For example, the fluid passageway may be formed from the centerbore 416 to an aperture 506A-B.

FIG. 9A shows a first surface (e.g., top surface) of the end cover 900A including one or more apertures 506A-B. The top surface may be configured to be coupled to, connected with, or integrated with a rotor (e.g., rotor 502 of FIG. 5). FIG. 9B shows a second surface (e.g., a bottom surface) of the end cover 900B. The bottom surface may be configured to be coupled to, connect with, or integrated with a seal plate (e.g., seal plates 1000A-B). End cover 900A-B may be a bottom end cover (e.g., end cover 316B of FIG. 3) in a hydraulic energy system (e.g., hydraulic energy transfer system 300 of FIG. 3)

Figure 10A:
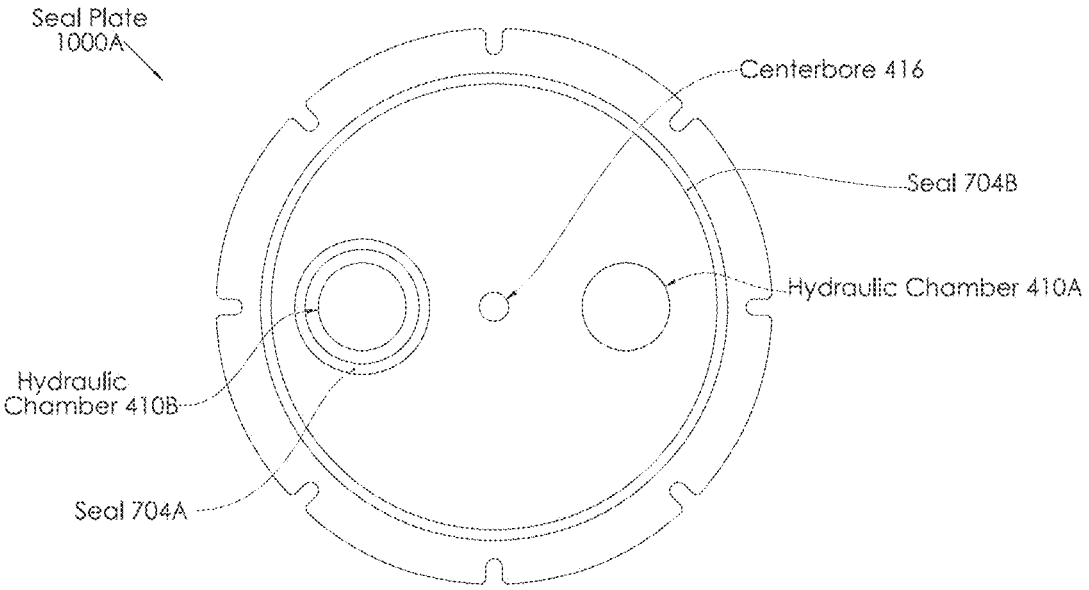
FIGS. 10A-B illustrate seal plates of a cartridge assembly, according to certain embodiments.
Figure 10B:
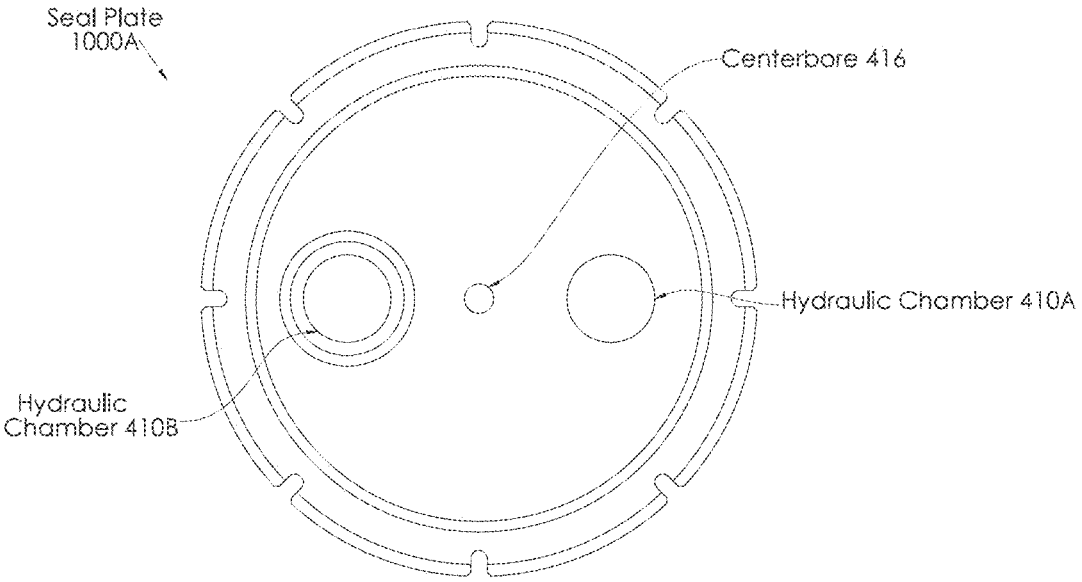

FIGS. 10A-B illustrate seal plates 1000A-B of a cartridge assembly (e.g., cartridge assembly 400 of FIG. 4), according to certain embodiments. Some elements in FIGS. 10A-B may have the same number as other figures, and these elements may be substantially similar to those elements having the same number in other figures. As shown in FIG. 10A, the seal plate 1000A may include one or more seals 704A-B, one or more hydraulic chambers 410A-B, and a centerbore 416. As shown in FIG. 10B, the seal plate 1000B may include a centerbore 416, and one or more hydraulic chambers 410A-B. Embodiments and corresponding elements illustrated in FIGS. 10A-B may include or be similar to features of seal plate 700A-B as disclosed in association with FIGS. 7A-B. In some embodiments, the seal plate 1000A-B forms one or more fluid passageways. For example, the fluid passageway may be formed from the centerbore 416 to one of hydraulic chambers 410A-B.

FIG. 10A show a first surface (e.g., top surface) of the seal plate 1000A and includes one or more seals 704A-B, hydraulic chambers 410A-B, and a centerbore 416. The top surface may be configured to be coupled to, connected with, or integrated with one of end covers 900A-B. FIG. 10B shows a second surface (e.g., a bottom surface) of the seal plate 1000B. The bottom surface may be configured to be coupled to, connect with, or integrate with a housing (e.g., housing endcap 312B of FIG. 3). Seal plate 1000A-B may be a bottom seal plate (e.g., seal plate 314B of FIG. 3) in a hydraulic energy system (e.g., hydraulic energy transfer system 300 of FIG. 3)

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about," "substantially," or "approximately" is used herein, this is intended to mean that the nominal value presented is precise within ±10%.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner. In one embodiment, multiple metal bonding operations are performed as a single step.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which each claim is entitled.

What is claimed is:

1. A pressure exchanger comprising:

a rotor configured to receive a first fluid, receive a second fluid, and exchange pressure between the first fluid and the second fluid;

a first component forming a low-pressure port, wherein the first fluid is routed between the rotor and the low-pressure port via a low-pressure passageway; and a second component comprising a piston that extends from a main body of the second component, the second component forming the low-pressure passageway through the piston and the main body, the second component forming a centerbore through the piston and the main body, an upper surface of the piston forming a fluid passageway between the low-pressure passageway and the centerbore.

2. The pressure exchanger of claim 1 further comprising:

a shaft attached to the rotor, wherein the shaft is routed through the centerbore; and a motor coupled to the shaft, wherein the motor is configured to control rotation of the rotor via the shaft.

3. The pressure exchanger of claim 1, wherein the first component is a housing endcap.

4. The pressure exchanger of claim 3, wherein the second component is a seal plate.

5. The pressure exchanger of claim 4 further comprising an end cover disposed between the seal plate and the rotor, the end cover forming one or more apertures, wherein the end cover is configured to direct flow of the first fluid between the seal plate and the rotor via the one or more apertures.

6. The pressure exchanger of claim 5, wherein the housing endcap, the seal plate, the end cover, and the rotor each form a corresponding portion of the centerbore, wherein a shaft is routed through the housing endcap, the seal plate, and the end cover.

7. The pressure exchanger of claim 1, wherein the first component further forms a high-pressure port.

8. A pressure exchanger comprising:

a housing endcap forming a low-pressure port, wherein a first fluid is to be routed between a rotor and the low-pressure port via a low-pressure passageway formed by the pressure exchanger; and a seal plate comprising a piston that extends from a main body of the seal plate, the seal plate forming the low-pressure passageway through the piston and the main body, the seal plate forming a centerbore through the piston and the main body, an upper surface of the piston forming a fluid passageway between the low-pressure passageway and the centerbore.

9. The pressure exchanger of claim 8, wherein the housing endcap, the seal plate, and the rotor each form a corresponding portion of the centerbore, wherein a shaft is routed through the housing endcap and the seal plate to attach to the rotor.

10. The pressure exchanger of claim 8, wherein the housing endcap further forms a high-pressure port.

11. The pressure exchanger of claim 8, wherein an adapter plate is disposed between the housing endcap and the seal plate.

12. The pressure exchanger of claim 9, wherein the fluid passageway is configured to cause the centerbore and the shaft to be at a lower pressure than an incoming high-pressure fluid.

13. A seal plate of a pressure exchanger, the seal plate comprising:

a main body forming a high-pressure passageway; and a piston that extends from the main body, the seal plate forming a low-pressure passageway through the piston and the main body, the seal plate forming a centerbore through the piston and the main body, an upper surface of the piston forming a fluid passageway between the low-pressure passageway and the centerbore.

14. The seal plate of claim 13, wherein a first fluid is to be routed between a rotor and a low-pressure port of a housing end cap via the low-pressure passageway of the seal plate.

15. The seal plate of claim 13, wherein a first fluid is to be routed between the low-pressure passageway of the seal plate and a rotor via an end cover.

16. The seal plate of claim 13, wherein a first seal is disposed on a lower surface of the main body around the high-pressure passageway.

17. The seal plate of claim 13, wherein a second seal is disposed on a lower surface of the main body around the low-pressure passageway, the centerbore, and the high-pressure passageway.

18. The seal plate of claim 13, wherein an upper surface of the main body and the upper surface of the piston are configured to be disposed against a lower surface of an adapter plate that forms a recess configured to receive at least a portion of the piston.

* * * * *